United States Patent [19]

Bardsley

[11] Patent Number: 4,662,291

[45] Date of Patent: May 5, 1987

[54] TUFTING MACHINE SLIDING NEEDLE BAR SUPPORT

[75] Inventor: H. Brian Bardsley, Euxton, Near Chorley, England

[73] Assignee: Spencer Wright Industries, Inc., Dalton, Ga.

[21] Appl. No.: 887,051

[22] Filed: Jul. 18, 1986

[51] Int. Cl.[4] ..... D05C 15/06

[52] U.S. Cl. ..... 112/80.41

[58] Field of Search ..... 112/80.41

[56] References Cited

U.S. PATENT DOCUMENTS

| | | | |
|---|---|---|---|
| 4,399,758 | 8/1983 | Bagnall | 112/80.41 |
| 4,465,001 | 8/1984 | Ingram | 112/80.41 |
| 4,501,212 | 2/1985 | Slattery | 112/80.41 |

*Primary Examiner*—Ronald Feldbaum

*Attorney, Agent, or Firm*—Alan Ruderman

[57] ABSTRACT

A tufting machine has a needle bar for carrying a plurality of needles for reciprocating into and out of a base material. A sliding needle bar mechanism may shift the needle bar laterally according to a pattern. The needle bar is mounted for reciprocation and for lateral movement relative to the direction of reciprocation by apparatus having a foot secured to a respective push rod of the tufting machine and laterally extending guide rods clamped to the foot. Blocks having linear bearings or bushings are secured to the needle bar and receive the guide rods so that upon lateral movement of the needle bar by means of the shifting apparatus the needle bar moves relative to the guide rods. This reduces the weight of the laterally moving mass and permits greater shifting speeds.

2 Claims, 4 Drawing Figures

TUFTING MACHINE SLIDING NEEDLE BAR SUPPORT

BACKGROUND OF THE INVENTION

This invention relates to tufting machines and more particularly to mounting apparatus for supporting the needle bar of a tufting machine for transverse or lateral movement relative to the direction of movement of the base material.

In the art of tufting one or more rows of yarn carrying needles are reciprocably driven through a base material fed through the machine to form loops that are seized by loopers or hooks oscillating below the base material in timed relationship with the needles.

The needles are typically mounted in a needle bar supported at the end of a plurality of push rods constrained for reciprocatory motion toward and away from the loopers or hooks. In those machines having a sliding needle bar arrangement, i.e., wherein the needle bar is controllably driven by pattern means transverse to the direction of movement of the backing material so as to break up the alignment of the longitudinal rows of tufts, reduce the affects of yarn streaking and provide patterning affects, a needle bar carrier supports the needle bar, the carrier being secured to the push rod and moving therewith and permitting the needle bar to reciprocate with the push rods yet slide relatively to the push rods.

The mounting of the needle bar for reciprocation while permitting transverse or lateral sliding movement in the prior art was originally by a support foot having a slideway within which the needle bar or a slide plate to which the needle bar was secured was mounted, the support foot being fastened to at least one push rod for reciprocation therewith. Thus, the needle bar reciprocated vertically with the support feet and could be moved laterally relative to the feet. The transverse or lateral drive for the needle bar generally is supplied by a pattern controlled shifter attachment which supplies the jogging motion to the needle bar by mechanism including a pair of rollers which straddle a plate and permits movement of the needle bar in two planes. Apparatus illustrating this construction is described in Ingram U.S. Pat. No. 4,465,001 and other prior art patents.

In order to reduce the frictional drag of the needle bar while laterally sliding, linear bearings were later mounted in the needle bar support feet with steel rods journalled in and carried by the bearings. The slide rods are clamped to blocks which in turn are secured to the needle bar so that the needle bar together with the blocks and slide rods may be moved laterally relative to the feet and push rods. Apparatus of this type is illustrated in Slattery U.S. Pat. No. 4,501,212.

As the speed of tufting machines has increased, a limitation on this speed has been the speed at which the needle bar can be shifted laterally. For example, if a tufting machine can operate with the needle bar reciprocating at 1400 to 1500 rpm, but the needle bar cannot be shifted laterally fast enough to permit running of the machine at 1200 rpm, then this lower speed is the maximum that the tufting machine with a shifter apparatus can operate. Since a substantial number of machines incorporate sliding needle bar apparatus, it has become necessary to devise apparatus for permitting the needle bar to be shifted laterally at the highest possible speeds.

SUMMARY OF THE INVENTION

Consequently, it is a primary object of the present invention to provide apparatus for mounting the needle bar of a tufting machine for movement laterally of the direction of movement of the base material, the apparatus providing reduced shifting loads and permitting higher shifting speeds.

It is another object of the present invention to provide apparatus for mounting the needle bar of a tufting machine for movement laterally of the direction of movement of the base material, the apparatus including support feet to which slide rods are clamped and the needle bar being slidably mounted for movement relative to the slide rods.

Accordingly, the present invention provides in a tufting machine having a needle bar for carrying a plurality of needles, apparatus for mounting the needle bar for reciprocation and for movement laterally relative to the direction of reciprocation, the apparatus having a foot secured to the reciprocating push rods driven by the tufting machine drive, guide rods clamped to the foot and extending in the lateral direction, and means secured to the needle bar for journally carrying the rods so that upon sliding movement applied to the needle bar by the sliding needle bar drive apparatus the needle bar moves relative to the guide rods. This is in contradistinction to the prior art wherein the guide rods move together with the needle bar. Thus, although the reciprocating mass of the needle bar system is the same, the mass sliding laterally is less than in the prior art. Since there is a mounting system at each push rod of the tufting machine, the reduction in sliding mass of the tufting machine is the cumulative amount of that at each push rod. Thus, substantially lower loads may be seen by the shifter drive apparatus such that higher speed operation is obtainable.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
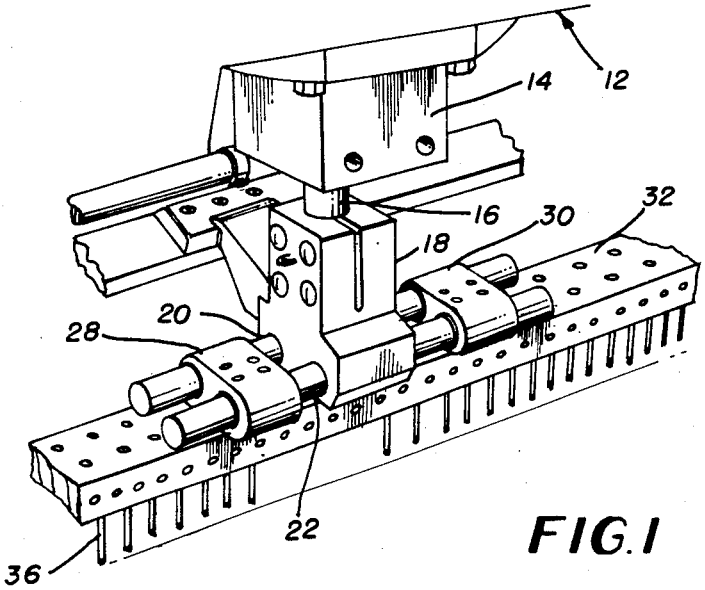
FIG. 1 is a front fragmentary perspective view of a tufting machine illustrating the mounting of the needle bar for laterally sliding relative to one of the reciprocating push rods.
Figure 2:
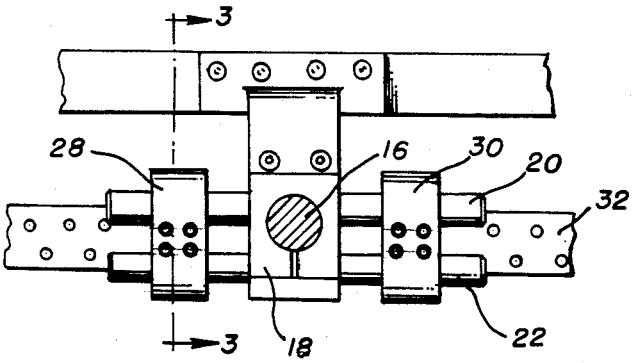
FIG. 2 is a horizontal cross sectional view taken substantially through the push rod of FIG. 1 looking downwardly toward the needle bar.
Figure 3:
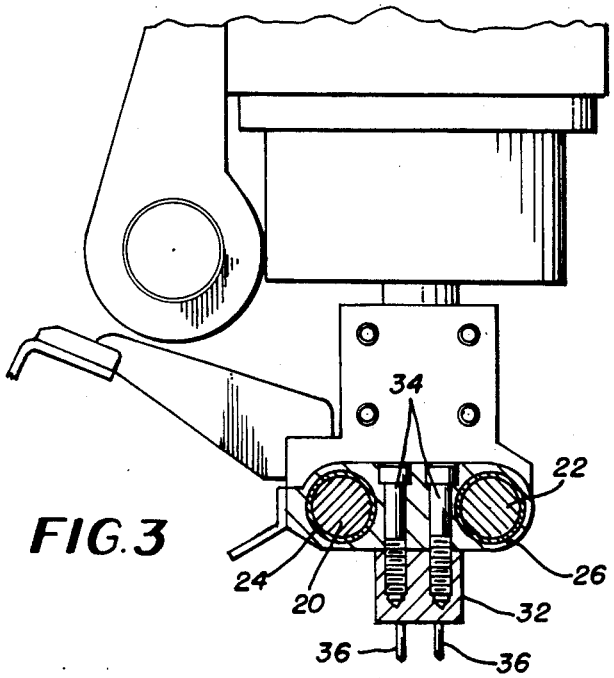
FIG. 3 is a cross sectional view taken substantially along line 3—3 of FIG. 2.
Figure 4:
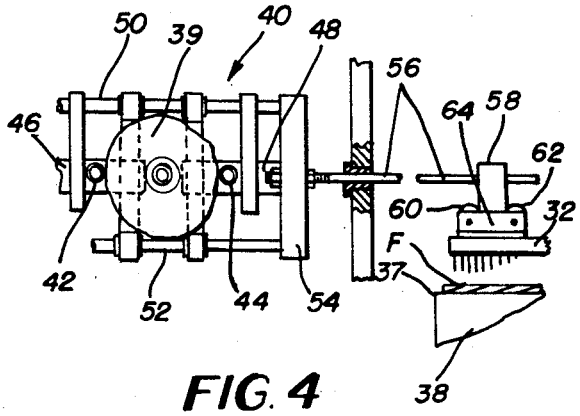
FIG. 4 is a diagrammatic view of a cam controlled shifter drive apparatus for sliding the needle bar relative to the push rods.

Referring to the drawings the relative portion of a tufting machine needle bar drive system is illustrated, the remainder of the tufting machine may be conventional and well known in the art so as not to be neccessary for the present disclosure. As illustrated, mounted in the head 12 of the tufting machine is one of a plurality of bushing housings 14 for journally mounting a respective push rod 16 which is reciprocably driven by drive means mounted in the head 12 as is notoriously well known in the tufting art. Fastened at the lower end of each push rod 16 is a support foot 18, the foot being a split member clamped about the push rod and secured thereto by screws or the like.

Securely carried in each foot 18 lying in a plane substantially normal to the axis of each push rod 16 is a pair of guide rods 20, 22, the rods being fixedly secured in each foot and therefore reciprocably moveable together with the respective push rod 16. The rods 20, 22 are spaced apart and each rod is journally mounted in a respective linear bearing or bushing 24, 26 carried in a pair of laterally spaced apart blocks 28, 30, there being one block adjacent each lateral side of the foot 18. The blocks 28, 30 are secured to the needle bar 32 by means of bolts 34 or the like so that reciprocation of the push rods 16 effects reciprocation of the needle bar 32 and the needles 36 carried therein. As the needle bar reciprocates the needles penetrate a base material F fed across the needle plate 37 on the bed 38 of the machine for cooperating with hooks or loopers (not illustrated) mounted in the bed for seizing loops of yarn from the needles as is well known in the art. Moreover, lateral shifting of the needle bar 32 results in the blocks 28, 30 moving along and relative to the guide rods 20, 22. Thus, when the needle bar is shifted laterally only the blocks 28, 30 are moved with it so that the mass of the system shifted is substantially less than that in the prior art.

To shift the needle bar laterally a pattern cam 39 may be rotatably mounted in a shifter drive assembly 40 supported adjacent the end of the tufting machine, the assembly carrying followers 42, 44 carried on brackets 46, 48. The assembly 40 may be similar to that illustrated in the aforesaid U.S. patents. The brackets 46, 48 are drivingly connected to slide rods 50, 52 fastened to another bracket 54 connected to a drive rod 56. The drive rod 56 is secured to a block 58 which is straddled by a pair of rollers 60, 62 carried by a bracket 64 which may be secured to the needle bar 32 or other means secured to the needle bar so that the needle bar may reciprocate relative to the block 58 yet be moved laterally with the block as determined by the cam 38. With the present invention the mass of the system as seen by the needle bar drive assembly is substantially less than in the prior art since only the two blocks 28, 30 and the associated bearings or bushings 24, 26 have been added to the needle bar for moving laterally.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a head including at least one push rod adapted for reciprocation therein, a needle bar reciprocably moveable with said push rod and carrying a plurality of needles for penetrating a base material, and needle bar shifting apparatus for moving said needle bar laterally relative to the reciprocation of said push rod in accordance with a pattern, apparatus for mounting the needle bar for reciprocation with the push rod,and for movement laterally relative to the direction of reciprocation, said apparatus including a foot secured to each push rod for reciprocating therewith, at least one guide rod secured to said foot and extending laterally, and block means fastened to said needle bar for journally supporting said guide rod for lateral movement relative thereto, whereby reciprocation of said push rods reciprocates said needle bar and upon lateral movement of said needle bar by said shifting apparatus said needle bar moves relative to said guide rod and said push rod.

2. In a tufting machine as recited in claim 1, wherein said block means comprises two blocks spaced apart laterally at opposite ends of said foot, each block having two linear bearing means for receiving a pair of guide rods for permitting movement of said blocks with said needle bar laterally relative to said guide rods.

* * * * *